US005151557A

United States Patent [19]

Bracuti et al.

[11] Patent Number: 5,151,557

[45] Date of Patent: Sep. 29, 1992

[54] ADDITIVE FOR PROPELLING CHARGE

[75] Inventors: Arthur J. Bracuti, Randolph; Louis A. Bottei, Hackettstown, both of N.J.

[73] Assignee: The United States of America as represented by the Secretary of the Army, Washington, D.C.

[21] Appl. No.: 724,252

[22] Filed: Jul. 1, 1991

[51] Int. Cl.[5] ..... F42B 5/02

[52] U.S. Cl. ..... 102/435; 102/511

[58] Field of Search ..... 102/435, 291, 511

[56] References Cited

U.S. PATENT DOCUMENTS

| | | | |
|---|---|---|---|
| H18 | 2/1986 | Bracuti et al. | 102/435 |
| 3,282,215 | 11/1966 | Roth | 102/435 |
| 3,362,328 | 1/1968 | Katz | 102/435 |
| 3,392,669 | 7/1968 | Picard | 102/435 |
| 3,392,670 | 7/1968 | Picard | 102/435 |
| 3,397,636 | 8/1968 | Jacobson et al. | 102/435 |
| 3,869,987 | 3/1975 | Berchielli | 102/343 |
| 3,920,575 | 11/1975 | Shiki et al. | 149/35 |
| 3,969,166 | 7/1976 | Sayles | 149/19.9 |
| 3,979,236 | 9/1976 | Sayles | 149/19.8 |
| 4,080,899 | 3/1978 | Lubman | 102/459 |
| 4,334,477 | 1/1982 | Axelrod et al. | 102/511 |
| 4,715,285 | 12/1987 | Höllen | 102/511 |
| 4,758,287 | 7/1988 | Pietz | 102/291 |

*Primary Examiner*—Edward A. Miller

*Attorney, Agent, or Firm*—Anthony T. Lane; Edward Goldberg; Edward F. Costigan

[57] ABSTRACT

An improved invention is provided having a propellant charge; propellant-containing bag or propellant-containing container which is coated with a composition for reducing muzzle flash and gun barrel erosion, the composition comprises sodium or potassium water glass and a volatile flash suppressant of $NH_4HCO_3$, $(NH_4)_2CO_3$ and/or $KHCO_3$.

3 Claims, No Drawings

ADDITIVE FOR PROPELLING CHARGE

BACKGROUND OF THE INVENTION

The present invention relates in general to means for reducing gun barrel erosion and muzzle flash from firearms and, more particularly, to the use of a composition which can be used for this purpose.

PRIOR ART

Muzzle flash and gun barrel erosion are two phenomena which have caused serious problems with past and present gun systems. Moreover, these problems hinder the development of new energetic gun systems. In an effort to solve these problems, it has been conventional to use selective additives to reduce flash and erosion of gun barrels. However, the success of these additives have been system limited because of the problems of packaging the additives in the propelling charge.

Gun barrel erosion has been described, e.g., in "A Study of the Erosion Process Using Several Group IV Oxides" by Linchitz, C and Silvesto, G, Tech. Report No. 1869, Picatinny Arsenal, Dover, NJ, December 1968.

Frequently, the packaging of these additives in the propelling charge is an extremely difficult, if not almost insurmountable, feat. (It is known, for example, to incorporate relatively benign erosion and flash additives ($TiO_2$, talc, $K_2SO_4$, $KNO_3$) in a wax cloth liner if there is sufficient space in the propelling charge.) Sometimes, however, space in the propelling charge is at a premium, and introduction of these benign additives in the proper configuration cannot be readily achieved. Also, with more volatile flash reducers, such as $(NH_4)_2CO_3$, $NH_4HCO_3$, and $KHCO_3$, this cannot be accomplished because the temperature required to melt the wax also results in volatilization of these additives.

Placement of some of these additives in the propelling charge without proper protection is also unsatisfactory because even at room temperature, sublimation occurs which causes a total loss of flash reducer over an extended period of time. One solution to this space problem has been to package the additives in a non-permeable plastic bag. However, there is often insufficient space in the propelling charge for the bag of additives.

It is, therefore, desirable to introduce an erosion additive and package the volatile flash reducers simultaneously. It is also desirable to provide a means to waterproof the propellant charge and also strengthen the propellant charge combustible case.

SUMMARY OF THE INVENTION

There is provided an improved munition containing a propellant charge and a composition for reducing muzzle flash and gun barrel erosion. The improvement resides in applying as a coating either on the propellant or on a combustible case a composition which contains a water glass of $Na_2O{\cdot}xSiO_2$ or $K_2O{\cdot}xSiO_2$, wherein x is 3–5. The coating may also contain a volatile flash suppressant.

It has been, surprisingly, discovered that muzzle flash and gun barrel erosion can be reduced by coating the propellant grains, propellant-containing bag, or propellant-containing container with an aqueous solution of water glass and drying same to form a hard waterproof coating. Suitable water glasses comprise $Na_2O{\cdot}xSiO_2$ or $K_2O{\cdot}xSiO_2$, or mixtures thereof, wherein x is 3–5.

The water glass is particularly advantageous because it is a polymorph which exists in two crystalline forms, one of which is soluble in the aqueous coating solution but the other being insoluble when the coating solution is dried. Preferably, the aqueous coating solution contains from about 5%–40%, more preferably from about 5%–20% by weight of the water glass. The coating solution can also contain small quantities of talc or $TiO_2$. Advantageously, the water glass containing aqueous solution can be applied at ambient temperatures and at atmospheric pressure. (Application by spraying or brushing on many thin coats is better than one thick coat.)

Preferably, the coating also contains either a volatile or non-volatile flash suppressant which can be mixed in the water glass. Preferred volatile flash suppressants include $NH_4HCO_3$, $(NH_4)_2CO_3$, and $KHCO_3$. The volatile flash suppressant can be used with the water glass in amounts of from about 3–26, more preferably from about 3%–6% by weight. When preparing the aqueous coating solution, the volatile flash suppressant can be added to the solution either before or after the water glass, although it is preferred to add water glass to the solution before the flash suppressant is introduced.

The coating composition of the present invention can be applied directly to propellant grains such as, for example, those having a diameter of from about ¼–1 inches and a length of from about 1–7 inches. In other cases, the propellant charge can be contained in a bag of case. In these cases, the bag itself can be coated with the water glass to form a hard waterproof coating.

In other instances where the propellant is in a container, such as one formed of fiber board or cellulosic fibers and nitrocellulose, the water glass coating can be applied directly to the outer surface of the container. In all cases, the dried water glass forms a hard waterproof coating on the propellant, propellant-containing bag, or propellant-containing container. The $SiO_2$ in the container acts as an erosion reducer when the charge is fired, and, if potassium water glass is used, a source of potassium flash suppressant is supplied to the propellant gases. If a volatile flash suppressant is mixed with the water glass, a coating containing the suppressant can be supplied to the propellant charge, case, or bag or the propellant grains. When dried, the water glass coating protects the volatile flash suppressant, strengthens and protects the case, and also acts as an erosion suppressant. In addition, the coating of the present invention provides a method for minimizing the problems of water sorption into the propellant grains themselves and strengthens the casing.

From the foregoing description, one skilled in the art can easily ascertain the essential characteristics of this invention, and without departing from the spirit and scope thereof, can make various changes and modifications of the invention to adapt it to various usages and conditions.

This water glass coating has also been used in the Unicharge program as a coating for the combustible Unicharge case. This coating has been shown to serve as both wear additive and atmospheric protective coating.

The application of this coating to the Unicharge case also has demonstrated the additional benefit of improving case mechanical properties which allows better rough handling characteristics, and also better performance with robotic/autoloaders. Without this coating, the autoloader would damage (excessive abrasion) the Unicharge case. Contact with the metal fingers of the robot arm and holding clamps in the weapon system holding racks abraded the exterior surface of the combustible case. The water glass coating provided a surface which did not abrade and withstood vibration and metal contact satisfactorily.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosure of all applications, patents and publications, cited above and below, are hereby incorporated by reference.

EXAMPLE

The efficacy of $Na_2SiO_3$ (water glass coating) as a wear additive in experimental M30 propelling charges was tested.

All tests were performed with the ARDEC vented erosion tester which is a 200 cc vented closed bomb containing a nine-inch long barrel with a ⅜-inch bore.

All propelling charges were fabricated with 50 grams of granular M30 propellant. The propelling charges were made in two configurations; the configuration consisted of placing the loose grains of M30 directly into the front of the chamber of the erosion tester; and the second configuration was to pack the M30 grains in a sealed polyethylene bag which was placed into the front of the chamber of the erosion tester. The former charge will be referred to as the loose charge and the latter will be called the bag charge.

The water glass was added to the charge in several different ways. The first addition technique was to add loose dry water glass powder in front of the loose charge. A second technique was to place the additive inside the bag charge. Included in this latter technique were 50/50 mixtures of dry water glass/ammonium bicarbonate and a water glass gel containing 60% water glass and 40% ammonium bicarbonate. In these modified propelling charges, the total amount of ammonium bicarbonate used was 8% in all cases.

A third technique was also used in which the M30 grains were coated with (1) water glass gels (20% aqueous dispersions of water glass); and (2) similar water glass gels containing ammonium bicarbonate. After the coatings dried, the coated M30 grains were made into propelling bag charges.

TABLE 1

| Additive (Dry unless otherwise noted) | Erosion g/shot |
|---|---|
| None Loose charge (LC) | 31(2) |
| None Charge in bag (CIB) | 12(2) |
| 4.4 g $Na_2SiO_3$ CIB in front | 6 |
| 4.4 g $Na_2SiO_3$ CIB in front | 6 |
| 2.2 g $Na_2SiO_3$ + 2.2 g $NH_4HCO_3$ CIB in front | 9 |
| Grains coated with 20% sol $Na_2SiO_3$ CIB | 8 |
| Grains coated (20% sol $Na_2SiO_3$/3% $NH_4HCO_3$) CIB | 10 |
| 4.4 g Gel 60/50:$Na_2SiO_3$/$NH_4HCO_3$ in front CIB | 8 |

("sol" is an aqueous dispersion)

The data in Table 1 reveals that the addition of water glass to the M30 propelling charge, in all configurations tested, significantly reduced the gun-barrel erosion caused by M30 propelling charge.

Limited flash data also demonstrates that water glass/salt mixtures (e.g., $KHCO_3$, $NH_4HCO_3$) also reduce muzzle flash intensity. Addition of $Na_2SiO_3$/$NH_4HCO_3$ additive in the bag were most effective in flash reduction. Coating the propellant grains with water glass/$NH_4HCO_3$ reduced flash but apparently not as effectively as adding the mixtures of the additives in bag charge. Grains coated with water glass alone were least effective in flash reduction. The substitution of potassium water glass for sodium water glass used in these tests may offer a means to improve the flash reduction efficacy.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In an improved munition for a gun comprising a propellant charge and a composition for reducing muzzle flash and gun-barrel erosion, the improvement consisting of water glass as an admixture with or adjacent grains of said propellant charge.

2. The munition of claim 1 wherein the water glass is $NaO.XSiO_2$ and X in between about 3 to 5.

3. The munition of claim 2 wherein the water glass is about 4% by weight based on the weight of said propellant.

* * * * *